US005640009A

United States Patent [19]

Hatakeyama

[11] Patent Number: 5,640,009

[45] Date of Patent: Jun. 17, 1997

[54] FAST ATOM BEAM SOURCE

[75] Inventor: Masahiro Hatakeyama, Kanagawa-ken, Japan

[73] Assignee: Ebara Corporation, Tokyo, Japan

[21] Appl. No.: 943,569

[22] Filed: Sep. 11, 1992

[30] Foreign Application Priority Data

Sep. 12, 1991 [JP] Japan ..... 3-261231

[51] Int. Cl.$^6$ ..... H05H 3/02

[52] U.S. Cl. ..... 250/251

[58] Field of Search ..... 250/251; 315/111.21, 315/111.31, 111.81

[56] References Cited

U.S. PATENT DOCUMENTS

| | | | |
|---|---|---|---|
| 5,055,672 | 10/1991 | Nagai | 250/251 |
| 5,216,241 | 6/1993 | Hatakeyama et al. | 250/251 |

FOREIGN PATENT DOCUMENTS

| | | | |
|---|---|---|---|
| 0245867 | 11/1987 | European Pat. Off. . | |
| 0430081 | 6/1991 | European Pat. Off. . | |
| 0502429 | 9/1992 | European Pat. Off. . | |
| 63-43248 | 2/1988 | Japan | 250/251 |
| 1161699 | 6/1989 | Japan | 250/251 |
| 1231299 | 9/1989 | Japan | 250/251 |

OTHER PUBLICATIONS

Shimokawa, F. et al., "Reactive-fast-atom beam etching of GaAs using $Cl_2$ gas", J. Appl. Phys. 66(6), 15 Sep. 1989, pp. 2613–2618.

Nagai, K., "A FAB Source for SIMS—Studies of a Gas Discharge Type FAB Source—", an NTT Applied Electronics Laboratories Publication, Oct. 1988, pp. 29–34.

*Primary Examiner*—Jack I. Berman
*Assistant Examiner*—Kiet T. Nguyen
*Attorney, Agent, or Firm*—Wenderoth, Lind & Ponack

[57] ABSTRACT

A small fast atom beam source is capable of neutralizing ions at a high rate and of emitting a fast atom beam efficiently and with excellent directivity. A gas is introduced into the area between a plate-shaped anode having a plurality of atom emitting holes and a plate-shaped anode facing the cathode. A gas discharge is induced by a DC high-voltage power supply, thereby forming a plasma. Ions that are produced by the plasma are accelerated toward the cathode and neutralized in and near the atom emitting holes, which have lengths larger than the diameters thereof, thereby emitting a fast atom beam at a high rate of neutralization.

15 Claims, 2 Drawing Sheets

FAST ATOM BEAM SOURCE

BACKGROUND OF THE INVENTION

1. Field of the Invention

The present invention relates to a fast atom beam source which is capable of emitting a fast atom beam efficiently.

2. Prior Art

Atoms and molecules subject to thermal kinetics in atmosphere at room temperature generally have a kinetic energy of about 0.05 eV. Atoms and molecules that fly with a much larger kinetic energy than the above are generally called a "fast atoms", and when a group of such fast atoms flow in the form of a beam in one direction, it is called "fast atom beam".

FIG. 2 shows one example of a fast atom beam source that emits argon atoms with a kinetic energy of 0.5 to 10 keV, among conventional fast atom beam sources designed to generate a fast beam of gas atoms. In the figure, reference numeral 1 denotes a cylindrical cathode, 2 a doughnut-shaped anode, 3 a DC high-voltage power supply of 0.5 to 10 kV, 4 a gas nozzle serving as a gas introducing means, 5 argon gas, 6 a plasma, 7 atom emitting holes, 8 a fast atom beam, and 9 a discharge stabilizing resistor.

The constituent elements, exclusive of the DC high-voltage power supply 3 and the discharge stabilizing resistor 9, are placed in a vacuum container. After the vacuum container has been sufficiently evacuated, the argon gas 5 is injected into the cylindrical cathode 1 from the gas nozzle 4. Meanwhile, a DC high voltage is impressed between the doughnut-shaped anode 2 and the cylindrical cathode 1 from the DC high-voltage power supply 3 in such a manner that the anode 2 has a positive potential, and the cathode 1 a negative potential. Consequently, a gas discharge occurs between the cathode 1 and the anode 2 to generate a plasma 6, thus producing argon ions and electrons. During this process, electrons that are emitted from the bottom surface 10 of the cylindrical cathode 1 are accelerated toward the anode 2 and pass through the central hole in the anode 2 to reach the bottom surface 11 at the other end of the cathode 1. The electrons reaching the bottom surface 11 lose their speed there. Then, the electrons turn around and are accelerated toward the anode 2. Thus, the electrons oscillate at high frequency between the two bottom surfaces 10 and 11 of the cylindrical cathode 1 through the central hole in the anode 2. While undergoing the high-frequency oscillation, the electrons collide with the argon gas to produce a large number of argon ions.

The argon ions produced in this way are accelerated toward the bottom surface 11 of the cylindrical cathode 1 to obtain a sufficiently large kinetic energy. The kinetic energy obtained at this time is about 1 keV when the voltage impressed between the anode 2 and the cathode 1 is, for example, 1 kV. The space in the vicinity of the bottom surface 11 of the cylindrical cathode 1 forms a turning point for electrons oscillating at high frequency, where a large number of electrons in a low energy state are present. Thus, argon ions that enter this region return to argon atoms through collision and recombination with electrons. In the collision between ions and electrons, since the mass of electrons is much smaller than that of argon ions so that it can be ignored, the argon ions deliver kinetic energy to the atoms without any substantial loss, thus forming fast atoms. Accordingly, the kinetic energy of the fast atoms is about 1 keV. The fast atoms are emitted in the form of a fast atom beam 8 to the out side through the atom emitting holes 7 provided in the bottom surface 11 of the cylindrical cathode 1.

In the conventional fast atom beam source shown in FIG. 2, however, since the electric line of force in the discharge region is not perpendicular to the cathode but is distributed in an irregular form due to the douhgnut-shaped anode and the cylindrical cathode, there is a problem that the directivity of the fast atom beam is not satisfactory. This problem is particularly pronounced when a fast atom beam having a large diameter is produced. In addition, the rate of neutralization varies with the change in the rate at which the gas is introduced into the cylindrical cathode 1. The rate of neutralization herein means the ratio of the number of neutralized fast atom particles to the total number of particles in the beam emitted. In the case of the conventional fast atom beam source shown in FIG. 2, the rate of neutralization is in the order of 30% to 60%.

SUMMARY OF THE INVENTION

In view of the above-described prior art, it is an object of the present invention to provide a small fast atom beam source which is capable of efficently neutralizing ions and emitting a fast atom beam having excellent directivity.

To realize the above-described object, the present invention provides a fast atom beam source comprising: a casing; a plate-shaped cathode provided in said casing and having a plurality of atom emitting holes; a plate-shaped anode provided in said casing so as to face opposite to the plate-shaped cathode; means for introducing a gas into the area between said plate-shaped cathode and said plate-shaped anode; and a DC high-voltage power supply provided outside of said casing and operatively connected to said plate-shaped cathode and said plate shaped-anode for inducing an electric discharge in said area between said plate-shaped anode and said plate-shaped cathode. The atom emitting holes in the plate-shaped cathode preferably have a length which is in the range of 1 to 100 times the diameter thereof.

When negative and positive potentials are applied by the DC high-voltage power supply to the plate-shaped cathode and the plate-shaped anode, respectively, which are face each other, the gas that is introduced into the area between the two electrodes induces a gas discharge to generate a plasma, thus producing ions. The ions thus produced are accelerated toward the plate-shaped cathode placed at the negative potential, neutralized in and near the plurality of atom emitting holes and are emitted in the form of a fast atom beam from the atom emitting holes to the outside. By virtue of the plate-shaped anode and cathode facing each other, a beam with excellent directivity is formed. Further, if the length of the atom emitting holes are larger than the diameters, thereof, respectively ion particles are neutralized at a particularly high rate while passing through the atom emitting holes, resulting in an increase in the rate of neutralization of the atom beam.

The above and other objects, features and advantages of the present invention will become more apparent from the following description when taken in conjunction with the accompanying drawings in which a preferred embodiment of the present invention is shown by way of illustrative examples.

DETAILED DESCRIPTION OF THE PREFERRED EMBODIMENT

Figure 1:
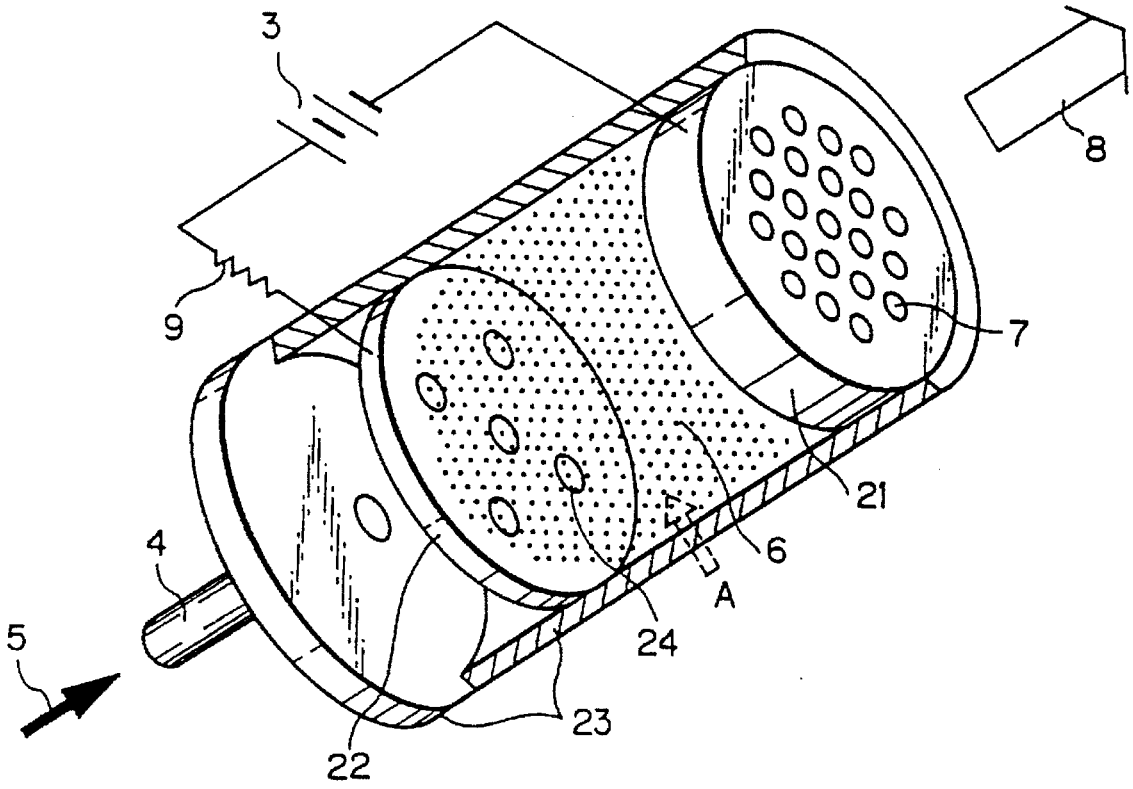
FIG. 1 illustrates a fast atom beam source according to one embodiment of the present invention.
Figure 2:
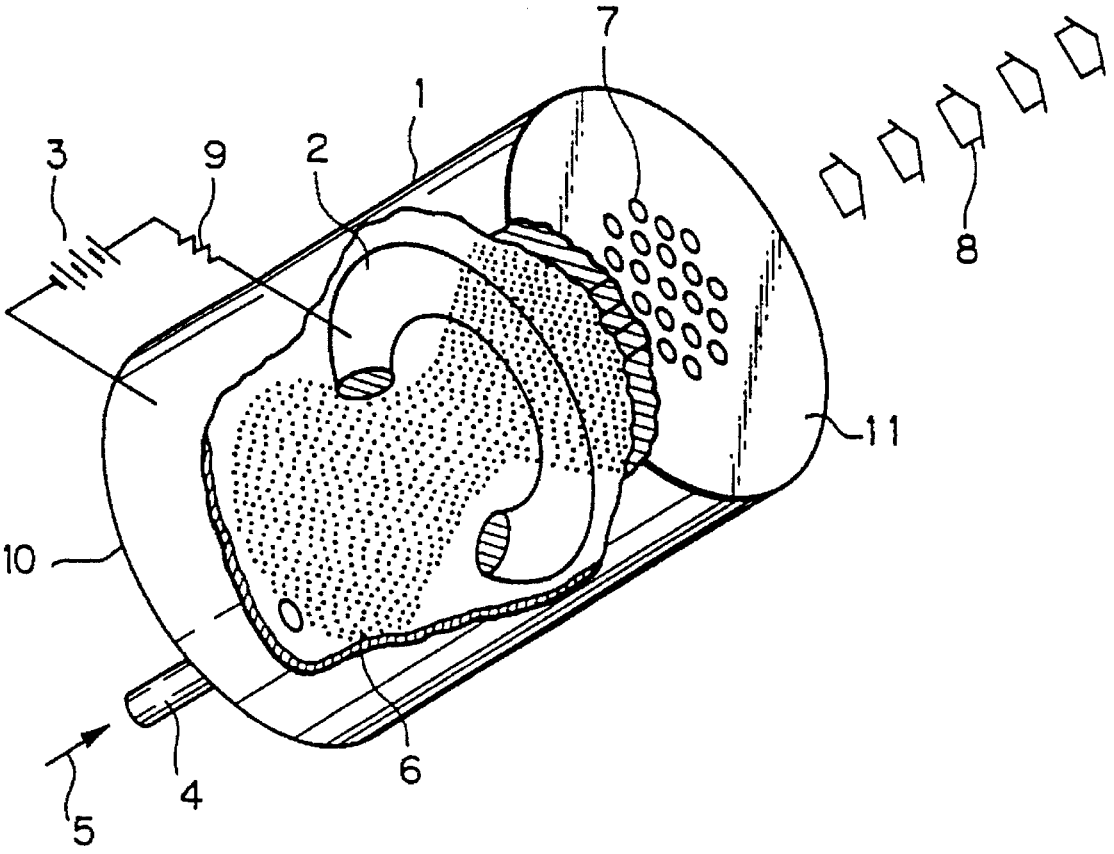
Fig. 2 PRIOR ART
FIG. 2 illustrates a fast atom beam source according to the prior art.

FIG. 1 illustrates a fast atom beam source according to one embodiment of the present invention. Reference numeral 21 denotes a plate-shaped cathode, 22 a plate-shaped anode, and 23 an insulative (ceramic) casing. As illustrated, the plate-shaped cathode 21 is provided with a plurality of atom emitting holes 7, while the plate-shaped anode 22 is provided with gas introducing holes 24. Reference numerals which are common to FIGS. 1 and 2 denote elements having the same functions; therefore, a description of these elements is omitted. The fast atom beam source in this embodiment operates as follows.

The constituent elements, exclusive of the DC high-voltage power supply 3 and the discharge stabilizing resistor 9, are placed in a vaccum container, and after the vacuum container has been sufficiently evacuated, a gas 5, e.g., argon gas, is introduced thereinto from a gas nozzle 4 serving as a gas introducing means, and a DC high voltage is impressed between the plate-shape cathode 21 and the plate-shaped anode 22 by the DC high-voltage power supply 3 with the cathode 21 and the anode 22 being placed at a negative potential and a positive potential, respectively. Consequently, a gas discharge occurs in the area between the plate-shaped cathode 21 and the plate-shaped anode 22. As a result, a plasma is generated, and gas ions e.g., argon ions, and electrons are produced. Thereafter, the gas ions thus produced are accelerated toward the plate-shaped cathode 21 by the negative potential applied thereto by the DC high-voltage power supply 3 to thereby obtain a large energy. The gas ions lose their electric charges through collision with the atoms and molecules of the gas 5 remaining in the atom emitting holes 7 or through recombination with electrons, thereby being converted into fast atoms. Thus, the fast atoms are emitted in the form of a fast atom beam 8 to the outside from the atom emitting holes 7.

The atom emitting holes 7 are formed such that the length thereof is larger than the diameter therof, i.e., the length is in the range of 1 to 100 times the diameter. Thus, when passing through the atom emitting holes 7 provided in the plate-shaped cathode 21, the gas ions lose their electric charge and are neutralized by collision with the atoms and molecules remaining therein, thus forming a fast atom beam. It is important to employ atom emitting holes having a proper length in order to raise the rate of neutralization of the ions. If the length of the atom emitting holes 7 is set in the range of several mm to several tens of mm when the diameter thereof is in the range of 1 mm to 2 mm, a high rate of neutralization, i.e., 80% or more, can be obtained in general. The optimal length of the atom emitting holes 7 depends on the kind, pressure and so forth of the gas that induces gas discharge. Although the atom emitting holes 7 need to be sufficiently long to allow the ions entering the atom emitting holes 7 to be neutralized at a high rate, if the holes 7 are excessively long, the energy required to form the desired fast atom beam is lost through excessive collision with the remaining gas particles.

In the embodiment shown in FIG. 1, the gas, e.g., argon gas, enters the insulative (ceramic) casing 23 from the gas nozzle 4 serving as a gas introducing member and passes through the gas introducing holes 24 provided in the plate-shaped anode 22 to enter the area defined as a discharge region between the plate-shaped anode 22 and the plate-shaped cathode 21. Ions that are produced by the gas discharge are accelerated toward the plate-shaped cathode 21 and emitted in the form of a fast atom beam from the atom emitting holes 7.

Accordingly, a beam having excellent directivity is formed by the arrangement comprising the plate-shaped anode 22 and the plate-shaped cathode 21, which face each other, and the plurality of atom emitting holes 7 that are provided in the plate-shaped cathode 21. If in this arrangement the plate-shaped anode 22 is provided with a plurality of gas introducing holes 24, the flow of the gas 5, e.g., argon gas, becomes even more uniform, so that the gas density in the discharge region can be made uniform, and the gas discharge can be induced stably. Accordingly, a uniform fast atom beam can be obtained.

The gas nozzle serving as a gas introducing means may be disposed inbetween the plate-shaped anode 22 and the plate-shaped cathode 21 as denoted by arrow A in FIG. 1. In this case, the plate-shaped anode 22 has no gas introducing holes 24. A gas, e.g., argon gas, that is introduced from the outside directly enters the area between the plate-shaped anode 22 and the plate-shaped cathode 21 and generates a plasma by a gas discharge, thus producing ions. With such a structure, the gas can be introduced perpendicularly to the fast atom beam 8 being emitted. Therefore, this structure may be conveniently employed in a case where the gas cannot be supplied from the anode side, and it also enables a reduction in the overall size of the apparatus.

As has been described in detail above, the present invention provides a small and highly efficient fast atom beam source which is capable of emitting a fast atom beam with a high rate of neutralization and having excellent directivity. Thus, since the fast atom beam obtained by the present invention is electrically neutral, it can be effectively applied not only to metals and semiconductors but also to insulators such as plastics, ceramics, etc., to which the ion beam technique cannot effectively be applied, in composition analysis, fine processing and so forth.

What is claimed is:

1. A fast atom beam source comprising: a casing; a cathode provided in said casing, said cathode having the shape of a flat plate and including a plurality of atom emitting holes therethrough; an anode provided in said casing opposite said cathode, said anode having the shape of a flat plate; means for introducing a gas into an area between said cathode and said anode; and a DC high-voltage power supply provided outside of said casing and operatively connected to said cathode and said anode for discharging said gas in said area between said anode and said cathode.

2. A fast atom beam source according to claim 1, wherein each of said atom emitting holes has a length which is in the range of 1 to 100 times the diameter thereof.

3. A fast atom beam source according to claim 2, wherein said gas introducing means includes a gas introducing hole provided in said anode.

4. A fast atom beam source according to claim 2, wherein said gas introducing means includes a plurality of gas introducing holes provided in said anode.

5. A fast atom beam source according to claim 2, wherein said gas introducing means includes a nozzle provided in said casing for introducing the gas from the outside of said casing directly into the area between said cathode and said anode.

6. A fast atom beam source according to claim 2, wherein said casing is formed of a ceramic.

7. A fast atom beam source according to claim 1, wherein said gas introducing means includes a gas introducing hole provided in said anode.

8. A fast atom beam source according to claim 1, wherein said gas introducing means includes a plurality of gas introducing holes provided in said anode.

9. A fast atom beam source according to claim 1, wherein said gas introducing means includes a nozzle provided in said casing for introducing the gas from the outside of said casing directly into the area between said cathode and said anode.

10. A fast atom beam source according to claim 1, wherein said casing is formed of a ceramic.

11. A fast atom beam source as claimed in claim 1, wherein each of said atom emitting holes has a length which is greater than the diameter thereof.

12. A fast atom beam source according to claim 11, wherein said gas introducing means includes a gas introducing hole provided in said anode.

13. A fast atom beam source according to claim 11, wherein said gas introducing means includes a plurality of gas introducing holes provided in said anode.

14. A fast atom beam source according to claim 11, wherein said gas introducing means includes a nozzle provided in said casing for introducing the gas from the outside of said casing directly into the area between said cathode and said anode.

15. A fast atom beam source according to claim 11, wherein said casing is formed of a ceramic.

* * * * *